US008337185B2

(12) United States Patent
Tanaka

(10) Patent No.: US 8,337,185 B2
(45) Date of Patent: Dec. 25, 2012

(54) ROTARY COMPRESSOR HAVING AN OIL SEPARATION PLATE THEREIN

(75) Inventor: Junya Tanaka, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 368 days.

(21) Appl. No.: 12/464,480

(22) Filed: May 12, 2009

(65) Prior Publication Data

US 2009/0293534 A1 Dec. 3, 2009

(30) Foreign Application Priority Data

May 27, 2008 (JP) ..... 2008-137883

(51) Int. Cl.
*F01C 21/00* (2006.01)
*F03C 2/00* (2006.01)
*F03C 4/00* (2006.01)

(52) U.S. Cl. ..... 418/270; 418/11; 418/60; 418/89; 418/94; 418/151; 418/DIG. 1; 184/6.16

(58) Field of Classification Search ..... 418/11, 418/60, 63, 88, 89, 94, 97, 100, 151, DIG. 1; 184/6.16
See application file for complete search history.

(56) References Cited

U.S. PATENT DOCUMENTS 3,781,138 A * 12/1973 Bellmer ..... 417/368
6,533,558 B1 * 3/2003 Matsumoto et al. ..... 417/410.3
7,131,821 B2 * 11/2006 Matumoto et al. ..... 417/244

FOREIGN PATENT DOCUMENTS

JP 54-719 U 1/1979
JP 03031599 A * 2/1991
JP 3-32191 U 3/1991
JP 07-010486 2/1995
JP 08-028476 1/1996
JP 2000-265956 A 9/2000
JP 2001012374 A * 1/2001
JP 2007-255214 10/2007
JP 2008263663 A * 10/2008

OTHER PUBLICATIONS

Japanese Office Action, and English translation thereof, issued in Japanese Patent Application No. 2008-137883 dated Sep. 18, 2012.

* cited by examiner

*Primary Examiner* — Theresa Trieu
(74) *Attorney, Agent, or Firm* — McDermott Will & Emery LLP

(57) ABSTRACT

A rotary compressor includes a compressor casing which includes a compression unit for sucking refrigerant gas from a low pressure side of a refrigerating cycle and ejecting the gas to a high pressure side of the refrigerating cycle, and a motor for driving the compression unit through a rotating shaft. The compressor has a gas hole formed on a rotor of the motor for causing a refrigerant gas below the motor to pass upward, and an oil separation plate having a central cylindrical portion, a curved portion continuous to the central cylindrical portion and curved in a radial direction, and an outer peripheral disk portion continuous to the curved portion and is fixed on the rotor by a rivet so that a lower end portion of the central cylindrical portion comes into close contact with the upper end of the rotor or an upper end plate of the rotor.

6 Claims, 6 Drawing Sheets

ROTARY COMPRESSOR HAVING AN OIL SEPARATION PLATE THEREIN

BACKGROUND OF THE INVENTION

1. Field of the Invention

The present invention relates to a rotary compressor used for a refrigeration cycle of a refrigeration apparatus, an air conditioner, and the like.

2. Description of the Related Art

A conventional hermetically-sealed type rotary compressor, in which an inner bottom portion of a casing is used as an oil reservoir, includes a rotary compressor element which is disposed on a lower portion of the casing; and a motor element which is composed of a stator and a rotator having a permanent magnet embedded in a projection disposed on a laminated iron core and which is disposed on an upper portion of the casing. A gas refrigerant ejected from the rotary compressor element passes through the motor element and is ejected from an ejection port disposed on an upper portion of the casing to an external refrigerant circuit. The hermetically-sealed type rotary compressor is also provided with a plurality of refrigerant passing holes formed to pass through the laminated iron core of the rotator in a vertical direction so that the gas refrigerant and mist-like oil pass therethrough; an oil separation plate which is disposed above an outlet of the refrigerant passing hole, has a plurality of radial spacer portions for forming an oil separation space between the oil separation plate and the upper surface of the rotator, and is composed of a nonmagnetic material; and an insertion hole formed passing through the laminated iron core in a vertical direction to cause a fixing member, which is inserted into the spacer portions and fixes the oil separation plate to the rotator, to pass therethrough (refer to, for example, Japanese Patent Application Laid-open No. 8-28476).

Furthermore, a DC motor for driving a crank shaft of a rotary compressor is composed of a stator held in a casing of the rotary compressor; and a rotor core rotatably held in the stator and having a refrigerant path formed thereto in an axial direction. The DC motor for the rotary compressor is provided with an oil separation unit which is formed on an end plate attached to the upper end portion of the rotor core and against which a gas refrigerant flow flowing out from an upper opening of the refrigerant path collides (refer to, for example, Japanese Utility Model Application Laid-open No. 7-10486).

Furthermore, a hermetically-sealed electrically driven compressor includes a hermetically-sealed vessel including an ejection port above a predetermined position; a motor composed of a stator disposed on the hermetically-seal vessel and a rotor disposed inside of the stator; a compression mechanism unit disposed below the motor in the hermetically-sealed vessel and driven by a drive shaft inserted into the rotor with a lubricant charged to the bottom of the hermetically-sealed vessel for lubricating the compression mechanism unit; a gas flow path composed of a plurality of through holes and formed on at least the rotor of the motor so as to communicate both the upper and lower ends of the rotor in an axial direction; and an approximately disk-shaped oil separation plate held away at a predetermined interval from the upper end of the gas flow path and rotated together with the rotor. The oil separation plate has a disk plate portion and a cylindrical wall which stands at right angles with respect to the disk plate portion and which has a hollow hole formed at the center of rotation. The drive shaft is inserted into and held in the cylindrical wall by being tightly engaged therewith (refer to, for example, Japanese Patent Application Laid-open No. 2007-255214).

However, according to the conventional technology disclosed in Japanese Patent Application Laid-open No. 8-28476, since the oil separation plate, which is disposed above the outlet of the refrigerant passing hole and has a plurality of radial spacers, is used to form the oil separation space between the oil separation plate and the upper surface of the rotator, the oil separation plate has a complex shape and is made by sintering, forging, cutting, and the like. Accordingly, it has a problem that the oil separation plate becomes thick and requires a large amount of a material, and thereby a manufacturing cost is increased.

According to the conventional technology disclosed in Japanese Utility Model Application Laid-open No. 7-10486, since the oil separation unit, against which the gas refrigerant flowing out from the upper opening of the refrigerant path collides, and which is press-molded in a complex concave/convex shape, is attached to the end plate which is attached to the upper portion of the rotor core, the oil separation unit needs to be press-molded at several steps so that it is not broken in the press process. Accordingly, many press metal molds are necessary and a manufacturing cost is increased as in the above mentioned case.

According to the conventional technology disclosed in Japanese Patent Application Laid-open No. 2007-255214, the oil separation plate has the disk portion and the cylindrical wall which stands at right angles to the disk portion and has the hollow hole formed at the center of rotation, and a drive shaft is inserted into and held in the cylindrical wall so that it is tightly engaged therein. Accordingly, it is necessary to extend a drive shaft, which needs to be accurately cut, above the upper end surface of the rotor. Further the oil separation plate must be inserted to the drive shaft under pressure by a pressure-insertion device. This requires a pressure insertion step and the pressure-insertion device needs to be added. Accordingly, it has a problem that time required for processing and assembling increases, and thereby a cost is increased as in the above-mentioned case.

SUMMARY OF THE INVENTION

It is an object of the present invention to at least partially solve the problems in the conventional technology.

According to an aspect of the present invention, a rotary compressor includes a hermetically-sealed upright cylindrical compressor casing having a refrigerant gas ejection portion disposed in an upper portion and a refrigerant gas suction portion disposed in a lower portion; a compression unit provided in a lower portion of the compressor casing for sucking refrigerant gas from a low pressure side of a refrigerating cycle through the suction portion and ejecting the refrigerant gas from the ejection portion to a high pressure side of the refrigerating cycle through the inside of the compressor casing; a motor provided in an upper portion of the compressor casing for driving the compression unit through a rotating shaft; a gas hole formed in a rotor of the motor for causing refrigerant gas below the motor to pass upward; and an oil separation plate having a central cylindrical portion, a curved portion continuous to the central cylindrical portion and curved in a radial direction, and an outer peripheral disk portion continuous to the curved portion, the oil separation plate being fixed on the rotor by a rivet so that a lower end portion of the central cylindrical portion comes into close contact with an upper end of the rotor or an upper end plate of the rotor at its entire periphery.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of a rotary compressor according to the present invention will be explained below in detail based on the drawings. Note that the present invention is not limited to the embodiments.

First Embodiment

Figure 1:
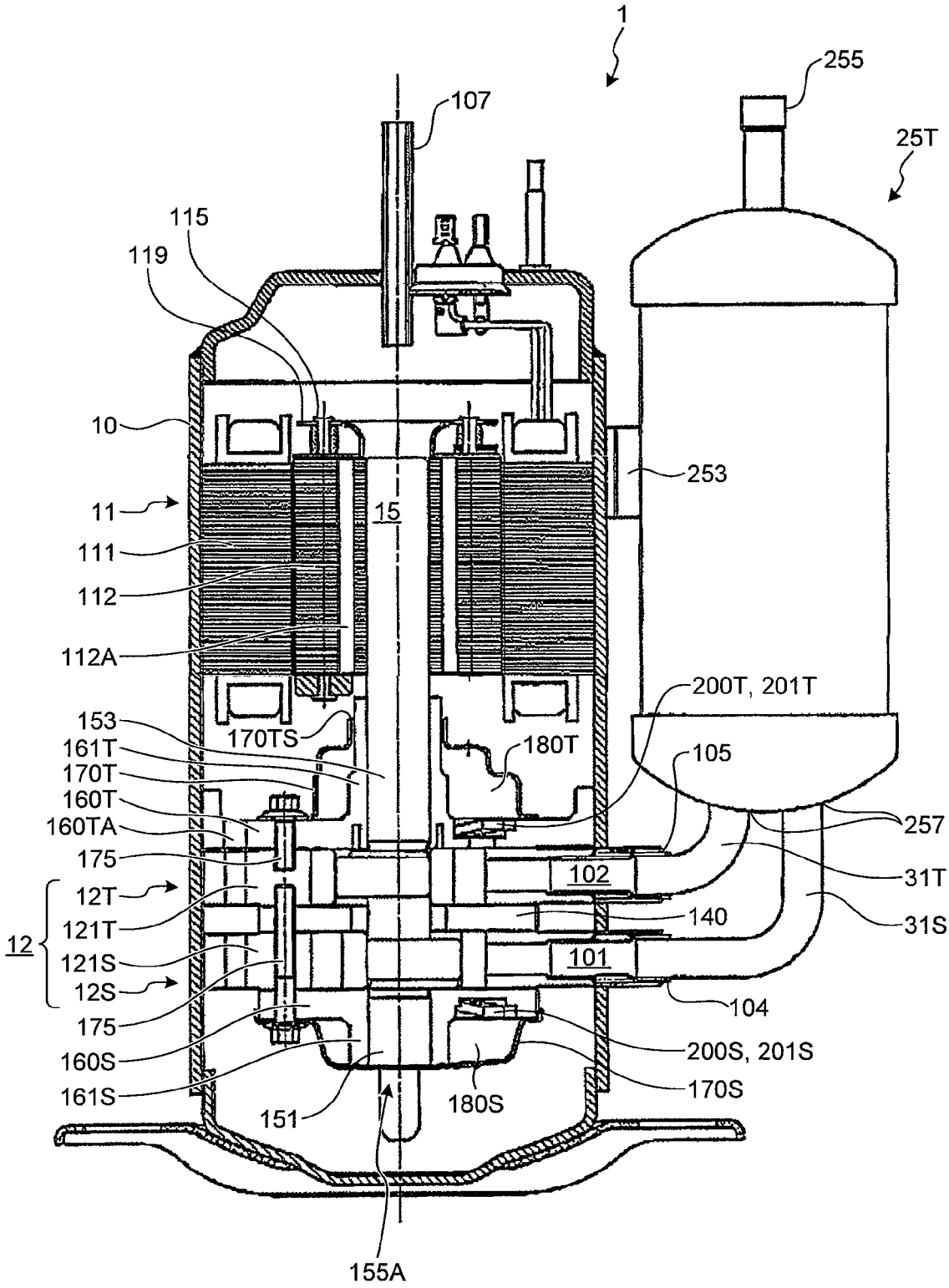
FIG. 1 is a longitudinal sectional view showing a first embodiment of a rotary compressor according to the present invention.
Figure 2:
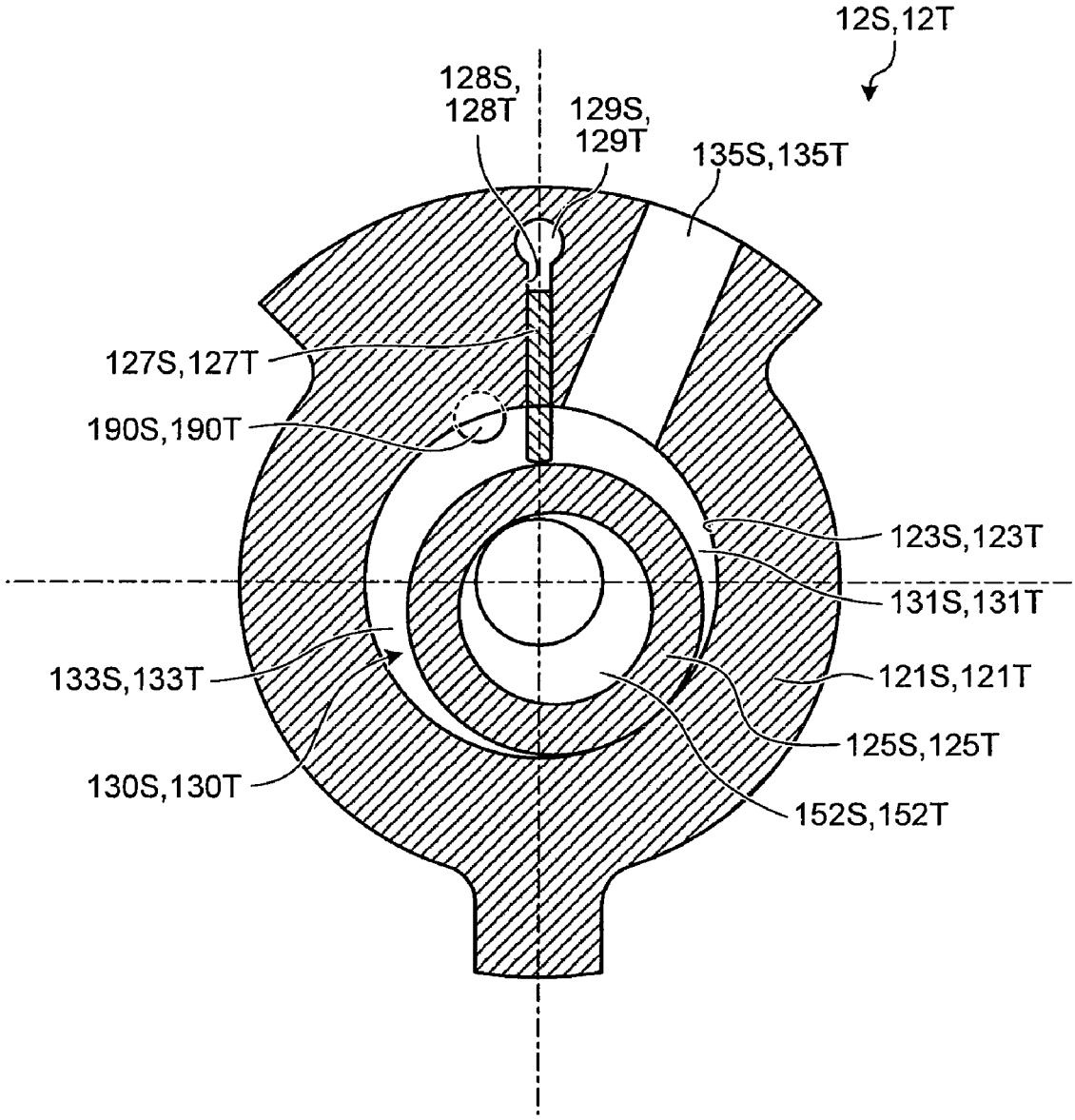
FIG. 2 is a lateral sectional view of first and second compression units.
Figure 3A:
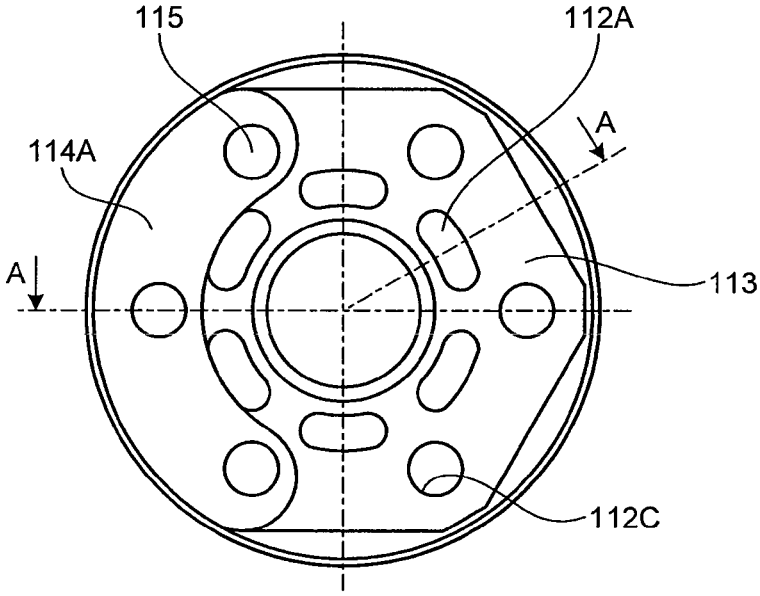
FIG. 3A is a lower plan view showing a rotor of the rotary compressor of the first embodiment.
Figure 3B:
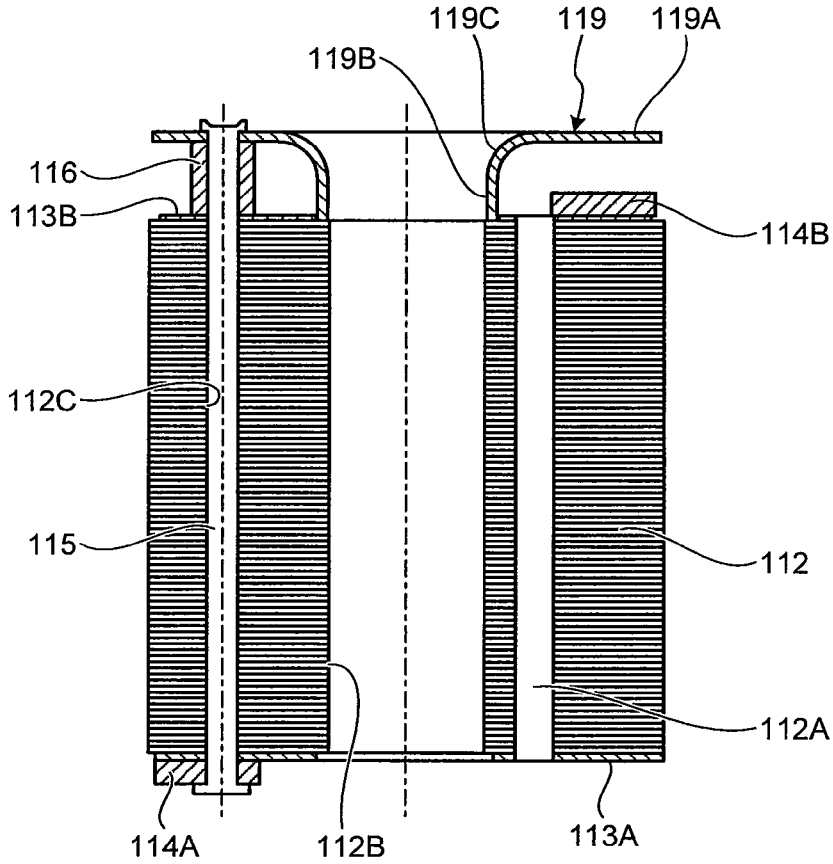
FIG. 3B is a sectional view taken along line A-A of FIG. 3A.

FIG. 1 is a longitudinal sectional view showing a first embodiment of the rotary compressor according to the present invention; FIG. 2 is a lateral sectional view of first and second compression units; FIG. 3A is a lower plan view showing a rotor of the rotary compressor of the first embodiment; and FIG. 3B is a sectional view taken along line A-A of FIG. 3A.

As shown in FIG. 1, the rotary compressor 1 of the first embodiment has a compression unit 12, which is installed on a lower portion of a hermetically-sealed upright cylindrical compressor casing 10, and a motor 11, which is installed on an upper portion of the compressor casing 10 and drives the compression unit 12 through a rotating shaft 15.

A stator 111 of the motor 11 is shrink-fitted and fixed around the inner peripheral surface of the compressor casing 10. A rotor 112 of the motor 11 is disposed on a center of the stator 111 and shrink-fitted and fixed to the rotating shaft 15 for mechanically connecting the motor 11 to the compression unit 12.

The compression unit 12 includes a first compression unit 12S and a second compression unit 12T which is installed alongside the first compression unit 12S and stacked on the first compression unit 12S. The first and second compression units 12S and 12T include first and second short cylindrical cylinders 121S, 121T.

As shown in FIG. 2, first and second circular cylinder inner walls 123S and 123T are formed on the first and second cylinders 121S and 121T concentrically with the motor 11. First and second annular pistons 125S and 125T each having an outside diameter smaller than the inside diameter of the cylinders are disposed on the first and second cylinder inner walls 123S and 123T, respectively. First and second operation chambers 130S and 130T (compression spaces), which suck, compress and eject refrigerant gas, are formed between the first and second cylinder inner walls 123S and 123T and the first and second annular pistons 125S and 125T.

First and second vane grooves 128S and 128T are formed on the first and second cylinders 121S and 121T in a radial direction from the first and second cylinder inner walls 123S and 123T to cover the entire heights of the cylinders, and first and second flat-sheet-shaped vanes 127S and 127T are engaged in the first and second vane grooves 128S and 128T.

Although not shown, first and second springs are disposed on inner portions of the first and second vane grooves 128S and 128T. Ordinarily, the first and second vanes 127S and 127T are projected from inside of the first and second vane grooves 128S and 128T into the first and second operation chambers 130S and 130T by the repellent force of the first and second springs, and the extreme ends thereof are abutted against the outer peripheral surfaces of the first and second annular pistons 125S and 125T. As a result, the first and second operation chambers 130S and 130T (compression spaces) are partitioned to first and second suction chambers 131S and 131T and first and second compression chambers 133S and 133T by the first and second vanes 127S and 127T.

Furthermore, back pressure introduction paths 129S and 129T are formed on the first and second cylinders 121S and 121T to cause the inner portions of the first and second vane grooves 128S and 128T to communicate with the inside of the compressor casing 10 so that back pressure is applied to the first and second vanes 127S and 127T by the pressure of compressed refrigerant gas.

First and second suction holes 135S and 135T are disposed on the first and second cylinders 121S and 121T to cause the first and second suction chambers 131S and 131T to communicate with the outside to suck a refrigerant to the first and second suction chambers 131S and 131T from the outside.

Furthermore, as shown in FIG. 1, the intermediate partition plate 140 is interposed between the first cylinder 121S and the second cylinder 121T to partition the first operation chamber 130S of the first cylinder 121S from the second operation chamber 130T of the second cylinder 121T. A lower end plate 160S is installed on the lower end portion of the first cylinder 121S and closes the first operation chamber 130S of the first cylinder 121S. Furthermore, an upper end plate 160T is installed on the upper end portion of the second cylinder 121T and closes the second operation chamber 130T of the second cylinder 121T.

A lower bearing unit 161S is formed on the lower end plate 160S, and a lower bearing support unit 151 of the rotating shaft 15 is rotatably supported by the lower bearing unit 161S. An upper bearing unit 161T is formed on the upper end plate 160T, and an upper bearing support unit 153 of the rotating shaft 15 is rotatably supported by the upper bearing unit 161T. Furthermore, six arc-shaped long outer peripheral through holes 160TA are disposed on the outer peripheral portion of the upper end plate 160T. The outer peripheral through holes 160TA are holes through which a lubricant, which is mixed with the refrigerant gas in the compression unit 12 and blown out to the upper portion of the compressor casing 10, returns to the lower portion of the compressor casing 10 after it is separated from the refrigerant gas.

The rotating shaft 15 has a first deflected portion 152S a second deflected portion 152T whose phases are offset 180° from each other. The first deflected portion 152S rotatably holds a first annular piston 125S of the first compression unit 12S, and the second deflected portion 152T rotatably holds a second annular piston 125T of the second compression unit 12T.

When the rotating shaft 15 rotates, the first and second annular pistons 125S and 125T rotate in the first and second cylinders 121S and 121T clockwise in FIG. 2 along the first and second cylinder inner walls 123S and 123T, and the first and second vanes 127S and 127T are reciprocated by the rotation of the first and second annular pistons 125S and 125T. The volumes of the first and second suction chambers 131S and 131T and the first and second compression chambers 133S and 133T are continuously changed by the movements of the first and second annular pistons 125S and 125T and the first and second vanes 127S and 127T, and the compression unit 12 continuously sucks, compresses, and ejects refrigerant gas.

As shown in FIG. 1, a lower muffler cover 170S is installed on the lower side of the lower end plate 160S, and a lower muffler chamber 180S is formed between the lower muffler cover 170S and the lower end plate 160S. The first compression unit 12S opens to the lower muffler chamber 180S. More specifically, a first ejection hole 190S (refer to FIG. 2) is formed in the vicinity of the first vane 127S of the lower end plate 160S to cause the first compression chamber 133S of the first cylinder 121S to communicate with the lower muffler chamber 180S, and a first ejection valve 200S is installed on the first ejection hole 190S to prevent backflow of a compressed refrigerant gas. The first ejection hole 190S and the first ejection valve 200S constitute a first ejection valve unit.

The lower muffler chamber 180S is one chamber, which communicates annularly, and is a part of a communication path for causing the ejection side of the first compression unit 12S to communicate with the inside of an upper muffler chamber 180T through a refrigerant path (not shown) which passes through the lower end plate 160S, the first cylinder 121S, the intermediate partition plate 140, the second cylinder 121T, and the upper end plate 160T. The lower muffler chamber 180S reduces pressure pulsation of ejected refrigerant gas. Furthermore, a first ejection valve presser 201S is fixed on and together with the first ejection valve 200S by a rivet to restrict the flexible opening amount of the first ejection valve 200S.

As shown in FIG. 1, an upper muffler cover 170T is installed on the upper side of the upper end plate 160T, and the upper muffler chamber 180T is formed between the upper muffler cover 170T and the upper end plate 160T. A second ejection hole 190T (refer to FIG. 2) is formed in the vicinity of the second vane 127T of the upper end plate 160T to cause the second compression chamber 133*t* of the second cylinder 121T to communicate with the upper muffler chamber 180T, and a second ejection valve 200T is installed on the second ejection hole 190T to prevent backflow of the compressed refrigerant gas. The second ejection hole 190S and the second ejection valve 200T constitute a second ejection valve unit. A gap (muffler ejection hole) 170TS is formed between the upper muffler cover 170T and the upper bearing unit 161T to flow out the refrigerant gas ejected from the second ejection valve unit into the compressor casing 10.

Furthermore, a second ejection valve presser 201T is fixed on and together with the second ejection valve 200T by a rivet to restrict the flexible opening amount of the second ejection valve 200T. The upper muffler chamber 180T reduces pressure pulsation of the ejected refrigerant gas.

The first cylinder 121S, the lower end plate 160S, the lower muffler cover 170S, the second cylinder 121T, the upper end plate 160T, the upper muffler cover 170T, and the intermediate partition plate 140 are integrally tightened by a bolt 175. The outer peripheral portion of the upper end plate 160T in the compression unit 12, which is integrally tightened by the bolt 175, is fixed to the compressor casing 10 by spot welding to thereby fix the compression unit 12 to the compressor casing 10.

Although not shown, first and second through holes 101 and 102 are formed on an outer periphery wall of the cylindrical compressor casing 10 so as to be sequentially separated from each other in an axial direction from a lower side so that first and second suction pipes 104 and 105 pass therethrough. Furthermore, an accumulator 25T, which is composed of an independent cylindrical hermetically-sealed vessel, is held on an outside portion of the compressor casing 10 by an accumulator holder and an accumulator band 253.

A system connection pipe 255, which is connected to a low pressure side of a refrigerating cycle, is connected to the center of a top portion of the accumulator 25T. First and second low pressure communication pipes 31S and 31T, which have one ends extending upward of the inside of the accumulator 25T and the other ends connected to the first and second suction pipes 104 and 105, are connected to bottom through holes 257 formed on the bottom of the accumulator 25T.

The first and second low pressure communication pipes 31S and 31T, which guide low pressure refrigerant of the refrigerating cycle to the first and second compression units 12S and 12T through the accumulator 25T, are connected to first and second suction holes 135S and 135T (refer to FIG. 2) of the first and second cylinders 121S and 121T through first and second suction pipes as a suction unit. More specifically, the first and second suction holes 135S and 135T communicate with the low pressure side of the refrigerating cycle in parallel with each other.

An ejection pipe 107 as an ejection unit, which is connected to a high pressure side of the refrigerating cycle and ejects high pressure refrigerant gas to the high pressure side of the refrigerating cycle, is connected to a top portion of the compressor casing 10. More specifically, the first and second ejection holes 190S and 190T communicate with the high pressure side of the refrigerating cycle.

A lubricant is contained in the compressor casing 10 approximately to the level of the second cylinder 121T. A longitudinal oil feed hole (not shown) is formed on the rotating shaft 15 so as to pass through the center thereof as well as a plurality of lateral oil feed holes (not shown) communicating with the longitudinal oil feed hole are formed. The plurality of lateral oil feed holes correspond to the lower bearing unit 161S, the first and second annular pistons 125S and 125T, and the upper bearing unit 161T. Furthermore, oil grooves (not shown), which communicate with the lateral oil feed holes, are disposed on the lower bearing unit 161S and the upper bearing unit 161T or to the portions of the rotating shaft 15 corresponding thereto.

Vanes (not shown) are inserted into the longitudinal oil feed hole so that an oil feed performance can be improved by applying centrifugal force to the lubricant by the vanes which are rotated together with the rotation of the rotating shaft 15, in particularly so that the upper bearing unit 161T, which is located at a position higher than a lubricant surface can be securely lubricated.

With an oil feed mechanism 155A described above, the lubricant, which is stored at the lower portion of the compressor casing 10, is drawn from the lower end portion of the rotating shaft 15 and lubricates the lower bearing unit 161S, the first and second pistons 125S and 125T, and the upper bearing unit 161T. After lubricant lubricates the respective portions, almost all the lubricant is discharged from the upper end of the oil groove of the upper bearing unit 161T and from the lower end portion of the oil groove of the lower bearing unit 161S, although a part of the lubricant enters the first and second operation chambers 130S and 130T from the minute gaps between the parts for partitioning the first and second compression units 12S and 12T and lubricates the sliding portions of the first and second operation chambers 130S and 130T and pressure-seals between the minute gaps thereof.

As shown in FIGS. 3A and 3B, as a characteristic arrangement of the rotary compressor of the first embodiment, the rotor 112 is formed in a columnar shape by laminating steel sheets and provided with a shaft hole 112B at the center and rivet holes 112C formed at six positions in an axial direction at the outer periphery. Furthermore, the rotor 112 has long gas holes 112A formed at six positions at the inner periphery to cause the refrigerant gas, which is ejected from the compression unit 12 and staying below the motor 11, to pass therethrough to the ejection pipe 107 side above the motor 11.

A rotor lower end plate 113A is fixed to the lower end portion of the rotor 112, and a rotor upper end plate 113B is fixed to the upper end thereof. An arc-shaped lower balancer 114A is disposed on the rotor lower end plate 113A and an arc-shaped upper balancer 114B is disposed on the rotor upper end plate 113B whose phase is offset 180° with respect to the lower balancer 114A so that the rotation of the compression unit 12 is balanced by them.

An oil separation plate 119 which has a central cylindrical portion 119B, a curved portion 119C continuous to the central cylindrical portion 119B and curved in a radial direction, and an outer peripheral disk portion 119A continuous to the curved portion 119C, is fixed on the rotor 112 so that the lower end portion of the central cylindrical portion 119B comes into close contact with the upper end of the rotor 112 and the inner peripheral portion of a central hole of the rotor upper end plate 113B.

The inside diameter of the central cylindrical portion 119B of the oil separation plate 119 is formed larger than the outside diameter of the rotating shaft 15 so that it does not come into contact with the rotating shaft 15. Furthermore, the outside diameter of the outer peripheral disk portion 119A is formed to have approximately the same diameter as the outside diameter of the rotor 112. Rivet holes are formed on the outer peripheral disk portion 119A of the oil separation plate 119 at positions facing the rivet holes 112C of the rotor 112.

Since the oil separation plate 119 has a simple shape having the cylindrical portion 119B at center of the outer peripheral disk portion 119A, it can be easily press-molded at a low cost using a minimum amount of a plate material. To perform the press-molding easily, the curved portion 119C preferably has a radius of curvature as large as possible. The radius of curvature of the curved portion 119C can be increased by forming the rivet holes as closer to the outer end of the outer peripheral disk portion 119A as possible.

Six cylindrical spacers 116 are disposed at the positions of the six rivet holes 112C between the outer peripheral disk portion 119A and the rotor upper end plate 113B, six rivets 115 are inserted through the lower balancer 114A or the upper balancer 114B, the rotor lower end plate 113A, the rotor 112, the rotor upper end plate 113B, the cylindrical spacer 116, and the outer peripheral disk portion 119A. The oil separation plate 119 is fixed to the rotor 112 by the six rivets 115.

Since the oil separation plate 119 can be caulked and fixed simultaneously with other rotor arrangement member in a caulking process of the rotor 112, it can be attached to the rotor 112 without increasing a cost without the need of addition of a new process and a manufacturing facility.

Next, an operation of the oil separation plate 119 of the first embodiment explained above will be explained. The refrigerant gas compressed by the compression unit 12 positioned below the motor 11 rises in the gas hole 112A of the rotor 112 and is ejected from the ejection pipe 107 to the outside of the rotary compressor 1. A part of the oil which lubricates the compression unit 12 rises in the gas hole 112A of the rotor 112 together with the refrigerant gas, impinges on the oil separation plate 119 and is centrifugally separated, and returns to an oil reservoir on the bottom of the compressor 1 by gravity.

To improve oil separation efficiency, it is necessary to centrifugally separate a larger amount of the oil by causing the refrigerant gas to pass through the gas hole 112A as much as possible. Since the oil separation plate 119 generates a refrigerant gas flow which travels in an outer periphery direction from the center of the oil separation plate 119 by centrifugal force, it also acts to suck the refrigerant gas below the motor 11 from the gas hole 112A and to increase the refrigerant gas passing through the gas hole 112A. To increase the force for sucking the refrigerant gas, the gas hole 112A is preferably disposed as closer to the center of the rotor as possible.

Second Embodiment

Figure 4:
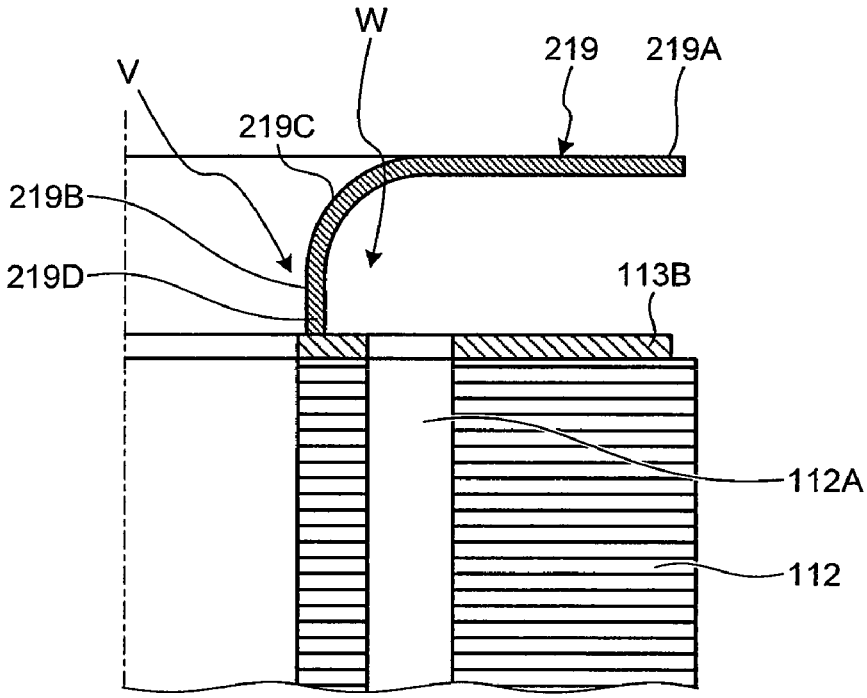
FIG. 4 is a longitudinal sectional view showing an oil separation plate of a second embodiment of the rotary compressor according to the present invention.

FIG. 4 is a longitudinal sectional view showing an oil separation plate of a second embodiment of the rotary compressor according to the present invention. As shown in FIG. 4, an oil separation plate 219, which has a central cylindrical portion 219B, a curved portion 219C continuous to the central cylindrical portion 219B and curved in a radial direction, and an outer peripheral disk portion 219A continuous to the curved portion 219C, is fixed on a rotor 112 by a river 115 so that the lower end portion 219D of the central cylindrical portion 219B comes into close contact with the outer end of a center hole of a rotor upper end plate 113B from above.

The inside diameter of the central cylindrical portion 219B of the oil separation plate 219 is formed larger than the outside diameter of a rotating shaft 15 so that it does not come into contact with the rotating shaft 15. Furthermore, the outside diameter of the outer peripheral disk portion 219A is formed to have approximately the same diameter as the outside diameter of the rotor 112.

Since the lower end portion 219D of the oil separation plate 219 is subjected to a cutting process after it is press-molded, it comes into close contact with the rotor upper end plate 113B at its entire periphery. Accordingly, a refrigerant gas is prevented from leaking from an inside space V of the central cylindrical portion 219B to an outside space W thereof. When a gap is formed between the lower end portion 219D and the rotor upper end plate 113B, since a refrigerant gas is sucked from the inside space V of the central cylindrical portion 219B to the outside space W thereof, oil separation efficiency is lowered because the amount of the refrigerant gas below the motor 11, which is sucked from the gas hole 112A, is reduced.

Third Embodiment

Figure 5:
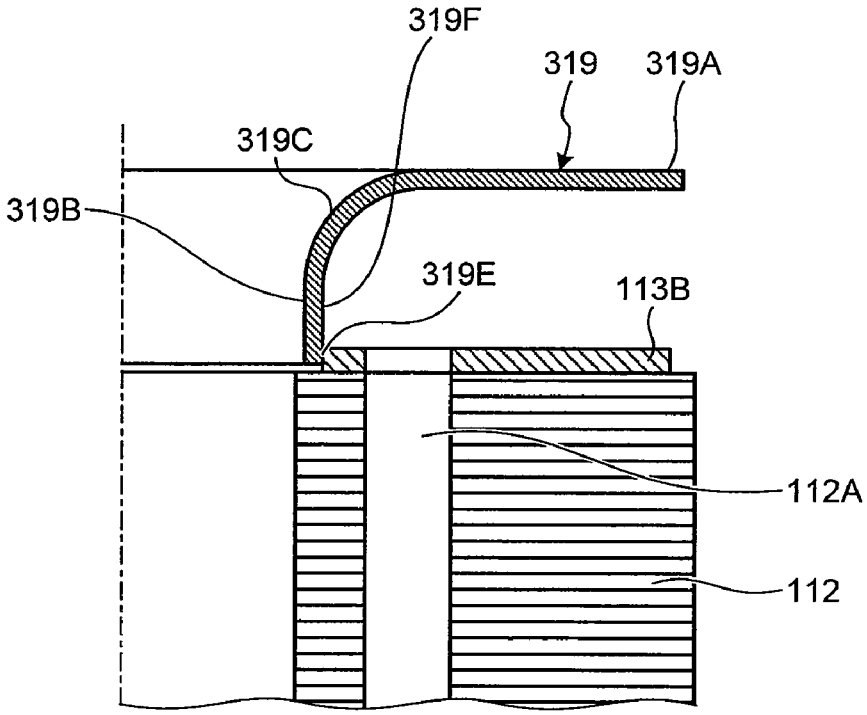
FIG. 5 is a longitudinal sectional view showing an oil separation plate of a third embodiment of the rotary compressor according to the present invention.

FIG. 5 is a longitudinal sectional view showing an oil separation plate of a third embodiment of the rotary compressor according to the present invention. As shown in FIG. 5, an oil separation plate 319, which has a central cylindrical portion 319B, a curved portion 319C continuous to the central cylindrical portion 319B and curved in a radial direction, and an outer peripheral disk portion 319A continuous to the curved portion 319C, is fixed on the rotor 112 by the river 115 and a cylindrical spacer 116 so that the lower end outer peripheral portion 319F of the central cylindrical portion 319B comes into close contact with the inner peripheral portion 319E of a center hole of a rotor upper end plate 113B at its entire periphery and is separated from the upper end of the rotor 112.

The inside diameter of the central cylindrical portion 319B of the oil separation plate 319 is formed larger than the outside diameter of a rotating shaft 15 so that it does not come into contact with the rotating shaft 15. Furthermore, the outside diameter of the outer peripheral disk portion 319A is formed to have approximately the same diameter as the outside diameter of the rotor 112.

Fourth Embodiment

Figure 6:
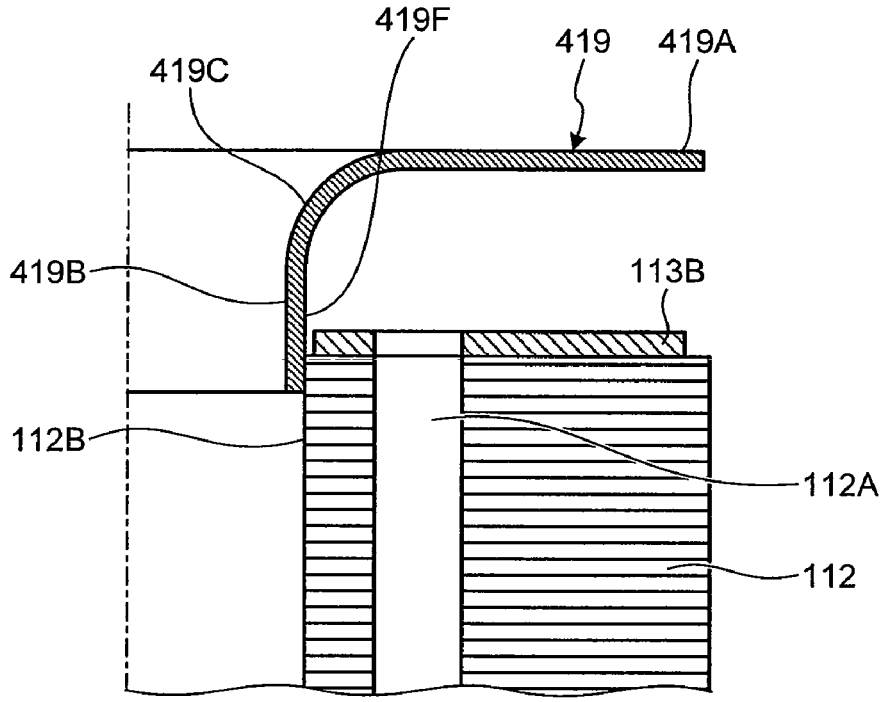
FIG. 6 is a longitudinal sectional view showing an oil separation plate of a fourth embodiment of the rotary compressor according to the present invention.

FIG. 6 is a longitudinal sectional view showing an oil separation plate of a fourth embodiment of the rotary compressor according to the present invention. As shown in FIG. 6, an oil separation plate 419, which has a central cylindrical portion 419B, a curved portion 419C continuous to the central cylindrical portion 419B and curved in a radial direction, and an outer peripheral disk portion 419A continuous to the curved portion 419C, is fixed on a rotor 112 by a river 115 and a cylindrical spacer 116 so that the lower end outer peripheral portion 419F of the central cylindrical portion 419B comes into close contact with the inner peripheral upper end portion of a shaft hole of the rotor 112 at its entire periphery.

The rotating shaft 15 is not inserted up to the upper end of the shaft hole 112B so that the lower end of the central cylindrical portion 419B of the oil separation plate 419 does not come into contact with the upper end the rotating shaft 15.

Fifth Embodiment

Figure 7:
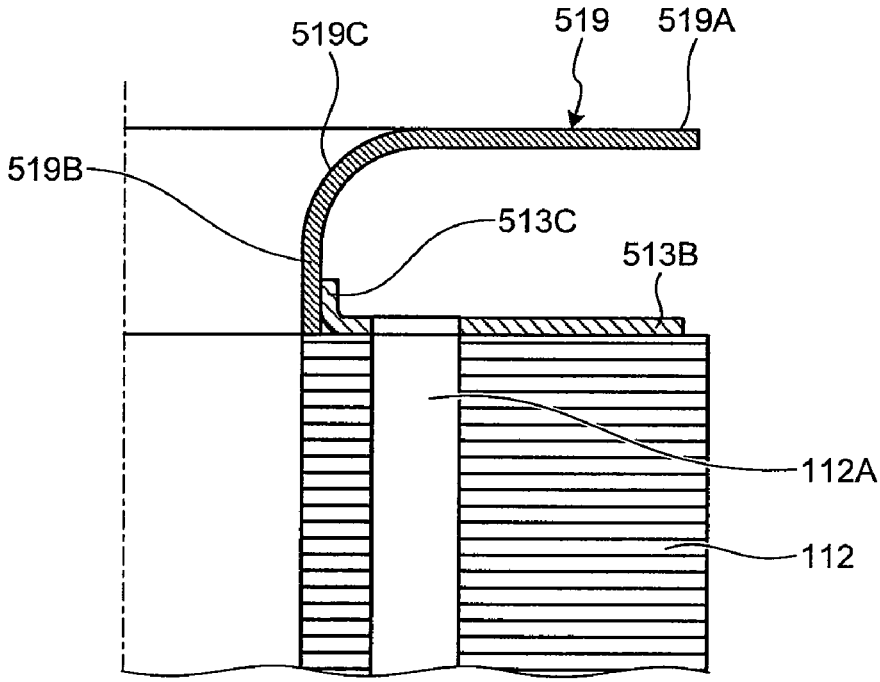
FIG. 7 is a longitudinal sectional view showing an oil separation plate of a fifth embodiment of the rotary compressor according to the present invention.

FIG. 7 is a longitudinal sectional view showing an oil separation plate of a fifth embodiment of the rotary compressor according to the present invention. As shown in FIG. 7, an oil separation plate 519, which has a central cylindrical portion 519B, a curved portion 519C continuous to the central cylindrical portion 519B and curved in a radial direction, and an outer peripheral disk portion 519A continuous to the curved portion 519C, is fixed on the rotor 112 by the river 115 and the cylindrical spacer 116 so that the lower end outer peripheral portion of the central cylindrical portion 519B comes into close contact with the inner peripheral portion of a central cylindrical portion 513C of a rotor upper end plate 513B at its entire periphery. Since raising the height of the central cylindrical portion 513C can increase a close contact area with the oil separation plate 519, oil separation efficiency can be improved by securely preventing leakage of refrigerant gas.

In the oil separation plates 319, 419, and 519 of the third to the fifth embodiments, the lower end outer peripheral portions of the central cylindrical portions 319B, 419B, and 519B are fixed so that they come into close contact with the inner peripheral portion 319E of the center hole of the rotor upper end plate 113B, the inner periphery upper end of the shaft hole 112B of the rotor 112, and the inner peripheral portion of the central cylindrical portion 513B of the rotor upper end plate 513B at its entire periphery, respectively.

When the oil separation plate is press-molded, since it is easier to accurately mold the roundness of the lower end outer peripheral portion thereof than to form the lower end of the central cylindrical portion thereof to be flat accurately, the oil separation plates 319, 419, and 519 of the third to the fifth embodiments (refer to FIGS. 5 to 7) can be made at a lower cost than the oil separation plate 219 of the second embodiment (refer to FIG. 4).

Sixth Embodiment

Figure 8A:
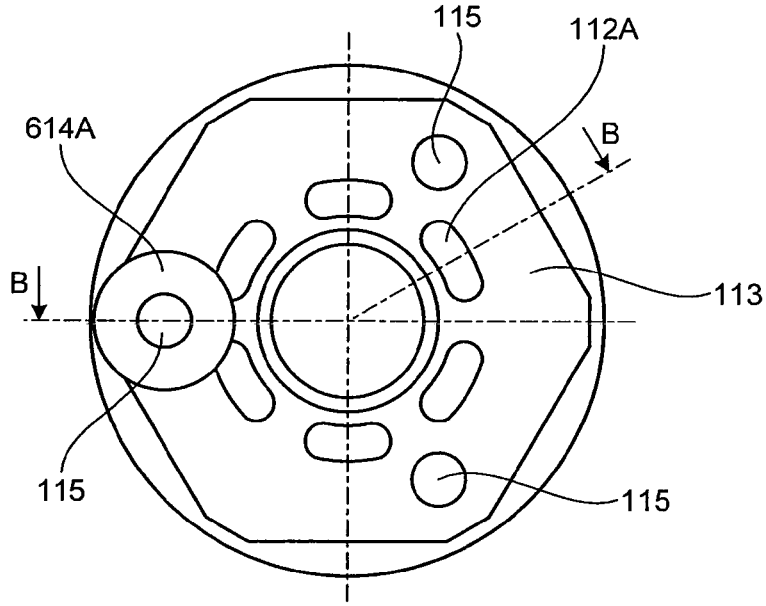
FIG. 8A is a lower plan view showing a rotor of a sixth embodiment of the rotary compressor according to the present invention.
Figure 8B:
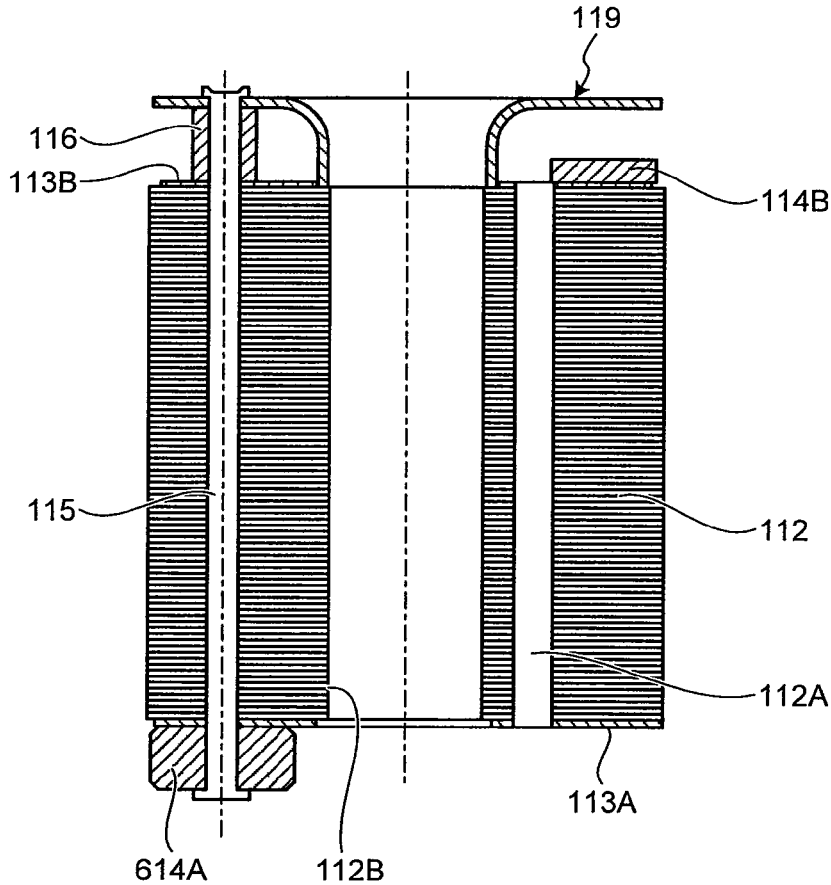
FIG. 8B is a sectional view taken along line B-B of FIG. 8A.

FIG. 8A is a lower plan view showing a rotor of a sixth embodiment of the rotary compressor according to the present invention, and FIG. 8B is a sectional view taken along line B-B of FIG. 8A. As shown in FIGS. 8A, and 8B, although the rotary compressor of the sixth embodiment is approximately the same as the rotary compressor 1 of the first embodiment, the former is different from the latter in that the arc-shaped lower balancer 114A of the former is arranged as the columnar lower balancer 614A in the latter.

The arc-shaped balancer 114A needs to be fixed by two or three rivets 115. When the arc-shaped balancer 114A is fixed by one rivet, the balancer 114A may be rotated about the rivet 115. Since the balancer 114A becomes unbalanced because the position of gravity thereof changes, disadvantages occur in that the balancer collides against the stator 111 positioned at the rotor outer peripheral portion and the rotary compressor becomes inoperable in addition to that the vibration of the rotary compressor is increased.

In the rotary compressor of the sixth embodiment, since the lower balancer is composed of the columnar lower balancer 614A, the balancer 614A does not collide against the stator 111 in addition to that the position of gravity of the balancer 614A does not change when it is rotated. Thus, there is no disadvantage to fixing the lower balancer by a single rivet.

Since the upper balancer is composed of the arc-shaped balancer 114B and fixed by the two rivets, three rivets 115 are used in total. In the rotary compressor 1 of the first embodiment shown in FIGS. 3A and 3B, although the six rivets 115 are used in total, the number of the rivets is reduced by forming the lower balancer in a columnar shape. As a result, a manufacturing cost can be lowered by reducing the number of parts and a caulking process time.

Furthermore, since the rivet 115 reduces the path area of the refrigerant gas passing through the gas hole 112A, the flow amount of the refrigerant gas can be increased by reducing the number of rivets so that the oil separation efficiency can be improved.

The upper balancer may be formed in a columnar shape and the lower balancer may be formed in an arc shaped. In this case, when the oil separation plate 119 is installed as high as the columnar upper balancer, the cylindrical spacer 116 of the upper balancer may be omitted. However, when the columnar upper balancer has a large outside diameter, since a refrigerant gas path is narrowed, the oil separation efficiency is deteriorated, it becomes difficult to press-mold the oil separation plate 119 because the radius of curvature of the curved portion 119C of the oil separation plate 119 needs to be reduced. Accordingly, it is preferable to make the outside diameter of the columnar upper balancer as small as possible.

Both the upper and lower balancers may be formed in a columnar shape. In this case, the number of the rivets 115 may be set to two pieces in total. However, when only two rivets are used, since the number of fixed positions is small, there is a possibility that the end plates 113A and 113B and the laminated steel sheets of the rotor 112 may partly float. Thus, it becomes necessary to take a countermeasure for making the end plate 113A and 113B thick, for example.

The columnar balancer 614A can be made at a low cost by making it by laminating steel sheets punched by a press. When the outside diameter of the columnar balancer 614A is set smaller than the inside diameter of the shaft hole 112B of the rotor 112, the columnar balancer 614A can be made at a further lower cost by using an extra steel sheet obtained when the shaft hole 112B is punched.

When a projection is formed on the lower side of the arc-shaped balancer, a recess is formed on the end plate, and the projection is engaged with the recess, the rotation of the balancer can be prevented even if it is fixed by one rivet. Furthermore, the rotation of the balancer may be prevented by cutting off the end plate to the same shape as the outer peripheral shape of the balancer and entirely engaging the balancer with the end plate.

Next, an operation of the rotary compressors of the first to the sixth embodiments explained above will be explained. The refrigerant gas, which is compressed by the compression unit 12 disposed below the motor 11, passes inside the motor 11 and is ejected to the outside of the compressor from the ejection pipe 107 disposed above the motor 11.

A part of the oil which lubricates the compression unit 12 rises in the gas hole 112A of the rotor 112 together with the refrigerant gas, collides against the oil separation plate and is centrifugally separated, and returns to the oil reservoir on the bottom of the compressor by gravity. Since the central cylindrical portion is formed on the oil separation plate and the lower end portion of the central cylindrical portion is caused to come into close contact with the rotor 112 or the rotor end plate 113B at its entire periphery, the refrigerant gas below the motor 11 can be effectively sucked from the gas hole 112A by the centrifugal force of the oil separation plate. Since the refrigerant gas passing through the gas hole 112A is increased and a larger amount of the oil is centrifugally separated, the oil separation efficiency can be improved.

Since the oil separation plate has a simple shape having the cylindrical portion formed on the center of the disk portion, it can be easily press-molded at a low cost. Since the lower end portion of the central cylindrical portion of the oil separation plate is caused to come into close contact with the rotor 112 or the rotor end plate 113B at its entire periphery, the oil separation efficiency is high. Since the oil separation plate is fixed to the rotor 112 by the rivet 115 through the standard size cylindrical spacer 116, it is less expensive.

Since the oil separation plate is caulked and fixed simultaneously with other members in the caulking process of the rotor 112, it does not increase a cost because it is not necessary to add a new process and a manufacturing facility. When the balancer is formed in the columnar shape, the path area of the refrigerant gas can be increased by reducing the number of the rivets 115 so that the oil separation efficiency can be improved. Furthermore, the number of parts and the time of the caulking process can be reduced by reducing the number of the rivets 115 to thereby reduce a cost.

A rotary compressor according to the present invention achieves an advantage that a rotary compressor having an oil separation plate whose processing and assembling costs are low can be obtained.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A rotary compressor comprising:

a hermetically-sealed upright cylindrical compressor casing having a refrigerant gas ejection portion disposed in an upper portion and a refrigerant gas suction portion disposed in a lower portion;

a compression unit provided in a lower portion of the compressor casing for sucking refrigerant gas from a low pressure side of a refrigerating cycle through the suction portion and ejecting the refrigerant gas from the ejection portion to a high pressure side of the refrigerating cycle through the inside of the compressor casing;

a motor provided in an upper portion of the compressor casing for driving the compression unit through a rotating shaft;

a gas hole formed in a rotor of the motor for causing refrigerant gas below the motor to pass upward; and an oil separation plate comprising:

a central cylindrical portion of which an inside diameter is formed larger than an outside diameter of the rotating shaft, so that the central cylindrical portion is not in contact with the rotating shaft; and a curved portion continuous to the central cylindrical portion and curved in a radial direction, and an outer peripheral disk portion continuous to the curved portion, wherein the oil separation plate is fixed on the rotor by a rivet so that a lower end portion of the central cylindrical portion comes into close contact with an upper end of the rotor or an upper end plate of the rotor at its entire periphery.

2. The rotary compressor according to claim 1, wherein the oil separation plate is fixed on the rotor so that a lower end outer peripheral portion of the central cylindrical portion comes into close contact with an inner peripheral upper end portion of a shaft hole of the rotor or an inner peripheral portion of a central hole of the upper end plate of the rotor at its entire periphery.

3. The rotary compressor according to claim 1, wherein the oil separation plate is fixed on the rotor by the rivet with a cylindrical spacer into which the rivet is inserted, the cylindrical spacer being sandwiched between the oil separation plate and the upper end plate of the rotor.

4. The rotary compressor according to claim 1, wherein the rivet also acts as a rivet for fixing a balancer to the rotor.

5. The rotary compressor according to claim 4, wherein the balancer is a columnar balancer.

6. The rotary compressor according to claim 4, wherein the oil separation plate is fixed on the rotor by one rivet for fixing a columnar lower balancer to the rotor and two rivets for fixing an arc-shaped upper balancer to the rotor.

* * * * *